US005765604A

United States Patent [19]

Garvey, III

[11] Patent Number: 5,765,604

[45] Date of Patent: Jun. 16, 1998

[54] GASOLINE SPILL ELIMINATOR

[76] Inventor: Thomas G. Garvey, III, 44 Washburne Ave., Berlin, N.J. 08009

[21] Appl. No.: 900,717

[22] Filed: Jul. 28, 1997

[51] Int. Cl.[6] ..... B65B 3/04

[52] U.S. Cl. ..... 141/86; 141/98; 141/383; 114/211; 114/343; 248/206.3

[58] Field of Search ..... 141/86, 311 A, 141/98, 383; 114/211, 343; 248/205.5, 206.2, 206.3, 206.4

[56] References Cited

U.S. PATENT DOCUMENTS

| | | | |
|---|---|---|---|
| 2,653,001 | 9/1953 | Padjen | 248/206.4 |
| 2,876,980 | 3/1959 | Salter | 248/206.3 |
| 2,980,379 | 4/1961 | Goldfus | 248/206.4 |
| 3,543,719 | 12/1970 | Pettyjohn | 141/383 |
| 3,948,476 | 4/1976 | Kuniyosi | 248/206.4 |
| 4,082,125 | 4/1978 | Wilson et al. | 141/86 |
| 4,776,431 | 10/1988 | Poling | 184/1.5 |
| 4,802,514 | 2/1989 | Morse | 141/86 |
| 4,836,482 | 6/1989 | Sokol | 248/206.3 |
| 4,865,156 | 9/1989 | Poling | 184/1.5 |
| 4,934,640 | 6/1990 | Bichon | 248/206.3 |
| 5,070,806 | 12/1991 | Coster | 114/343 |
| 5,121,776 | 6/1992 | Kovach | 141/98 |
| 5,230,372 | 7/1993 | Westphal | 141/86 |

*Primary Examiner*—J. Casimer Jacyna
*Attorney, Agent, or Firm*—Norman E. Lehrer

[57] ABSTRACT

A gasoline spill eliminator for attachment to the hull of a boat and over an overflow vent stack which extends therefrom. The gasoline spill eliminator includes a container for collecting and storing fuel emitted from the overflow vent stack. The container has a rear wall with an inlet opening therein. A flexible bracket with wings and a suction cup on each wing attaches the container to the boat. The bracket can also be rotated so that the position of the suction cups may be adjusted.

5 Claims, 2 Drawing Sheets

GASOLINE SPILL ELIMINATOR

BACKGROUND OF THE INVENTION

The present invention is directed toward a gasoline spill eliminator and, more particularly, toward a device for capturing the fuel from the overflow vent stack of a motorboat when the fuel tank of the same is full in order to prevent gasoline from polluting the water. The device can also be adjusted to various positions in order to properly fit over the overflow vent hole.

Many small to mid-size motorboats include a vent stack or tube leading from the gas tank thereof to the exterior of the boat through a vent hole in the hull or side of the same. However, not all holes and vent stacks are located in same place on the motorboat. (In some cases, the holes and vent stacks may be located in an obstructed area.) This vent hole not only allows fumes to vent from the tank but also provides a means for indicating when the fuel tank has been filled to the top. More specifically, when the fuel tank has been filled, a quantity of gasoline or other fuel will pour out of the overflow vent stack and into the water. Not only does this quantity of gasoline or other fuel pollute the waters where the boat is being refueled, but it also can create a serious fire hazard since the fuel tends to float on top of the water, where it remains combustible, instead of mixing with the water.

In recognition of the foregoing, several devices have been developed to prevent the spillage of gasoline from the tank of a boat. U.S. Pat. No. 4,802,514 to Morse, for example, discloses an open receptacle that is secured to the hull of a boat by suction cups beneath the vent stack. Gasoline that exits the vent stack flows downwardly into the receptacle by the force of gravity. This device must be removed every time the boat is refueled. Also, the suction cups are fixed in one position so that the receptacle may or may not be able to fit below the vent stack on all boats.

U.S. Pat. No. 5,070,806 to Coster also discloses a fuel overflow device that includes a receptacle that is secured to the hull of a boat by means of a suction cup. A flexible hose extends from the top of the receptacle to connect the same to the vent tube. The suction cup interferes with the free flow of gas from the container when one attempts to empty the same. This is due to the fact that the suction cup extends from the same end of the container as the discharge spout. Additionally, the Coster device cannot be firmly secured to the hull of the boat nor can the suction cup be moved about to accommodate various types of vent holes.

Existing fuel collection devices of the type described above are designed to be removed each the boat is refueled. However, if the tank of the boat is filled in the morning or on cold days, fuel often will escape through the overflow vent stack when the ambient temperature rises above a certain level and the volume of fuel expands. Such expansion also occurs in a winterized boat, which has had its gas tank filled, when the springtime approaches and the days get warmer. Furthermore, these fuel collection devices cannot be adjusted to accommodate a wide variety of vent holes.

SUMMARY OF THE INVENTION

The present invention is designed to overcome the deficiencies of the prior art discussed above. It is an object of the present invention to provide a gasoline spill eliminator for recapturing fuel from the overflow vent stack of a boat.

It is another object of the invention to provide a device that can be firmly secured to the boat for extended periods of time.

It is yet another object of the invention to provide a device that can be readily removed from the boat so that the contents contained therein can be recovered and reused.

It is a further object of the invention to provide a device with a flexible bracket that mounts the device via suction cups to the boat and is rotatable.

In accordance with the illustrative embodiments, demonstrating features and advantages of the present invention, there is provided a gasoline spill eliminator for attachment to the hull of a boat and over an overflow vent stack which extends therefrom. The gasoline spill eliminator includes a container for collecting and storing fuel emitted from the overflow vent stack. The container has a rear wall with an inlet opening therein. A flexible bracket with wings and a suction cup on each wing attaches the container to the boat. The bracket can also be rotated so that the position of the suction cups may be adjusted.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 2:
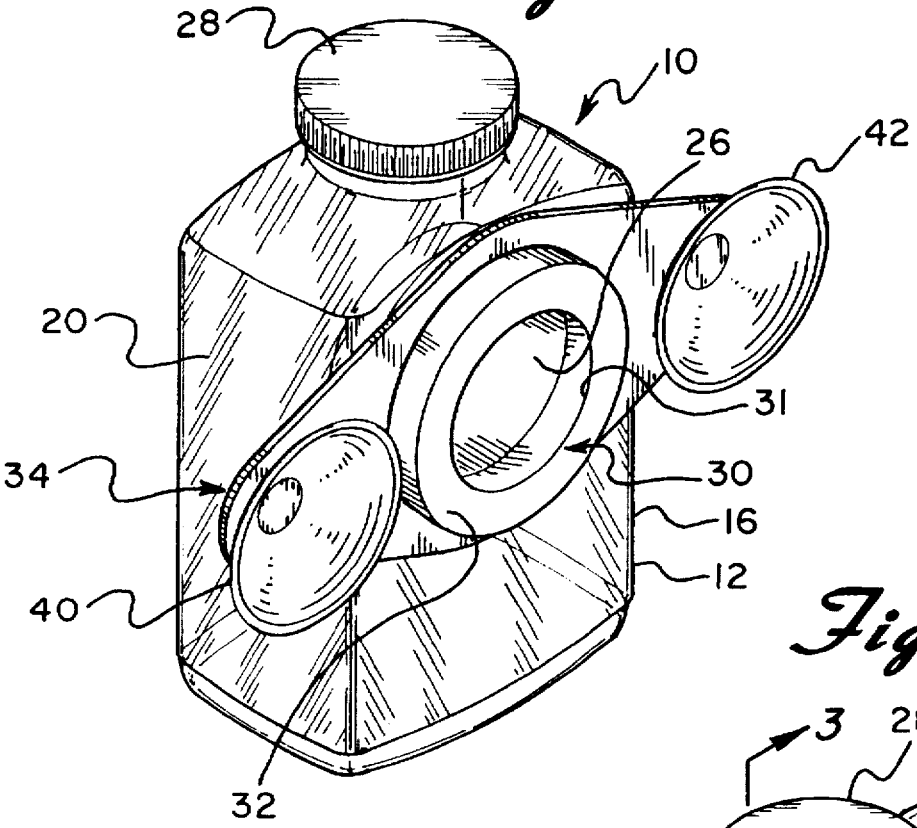
FIG. 2 is a rear perspective view of the gasoline spill eliminator with the mounting bracket.
Figure 1:
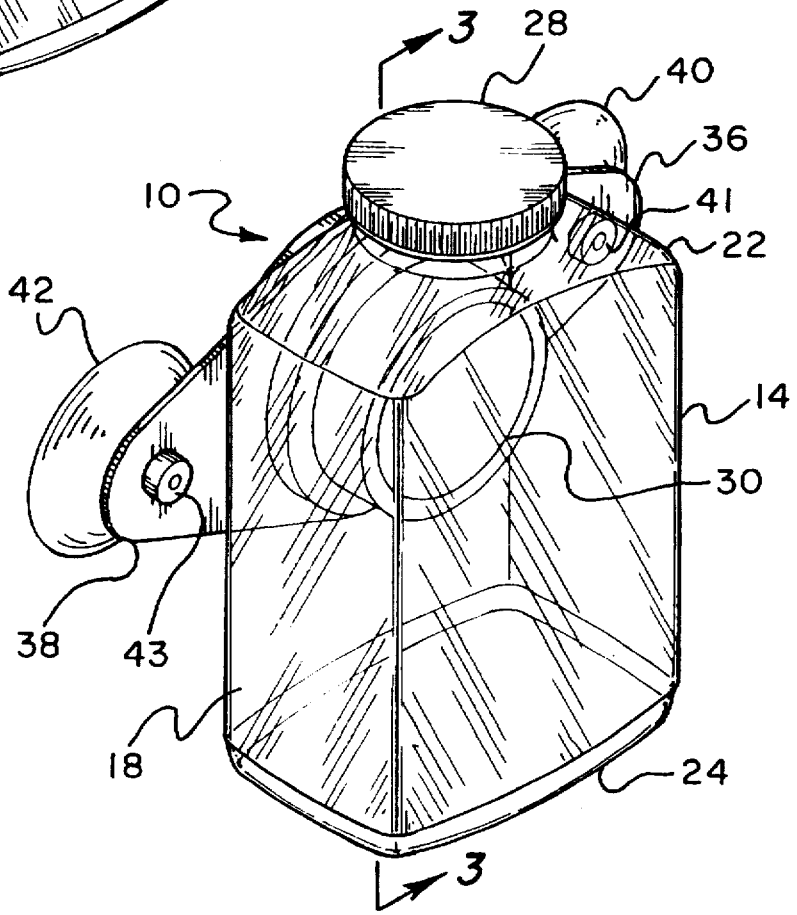
FIG. 1 is a front perspective view of the gasoline spill eliminator of the present invention with a mounting bracket.

Referring now to the drawings in detail wherein like reference numerals have been used throughout the various figures to designate like elements, there is shown in FIGS. 1 and 2 a gasoline spill eliminator constructed in accordance with the principles of the present invention and designated generally as 10.

The gasoline spill eliminator 10 includes a container 12 which preferably has a rectangular configuration although it could be made of various shapes. The container 12 has a front wall 14, a rear wall 16, a right wall 18, a left wall 20, a top wall 22, and a bottom wall 24. The rear wall 16 has an inlet opening 26 formed therethrough and a gasket 30 secured within the opening. The gasket 30 may be made from rubber and has a central hole 31 formed therethrough. The gasket also has a portion 32 which extends outwardly from the container. A cap (not shown) fits into the hole 31 so that the opening can be closed. The top wall 22 also has an opening closed by a screw cap 28. In the preferred embodiment, at least one of the vertical walls 14, 16, 18, or 20 or a portion thereof is comprised of a translucent material in order to allow one to visually ascertain whether any fuel has entered the container 12.

Figure 4:
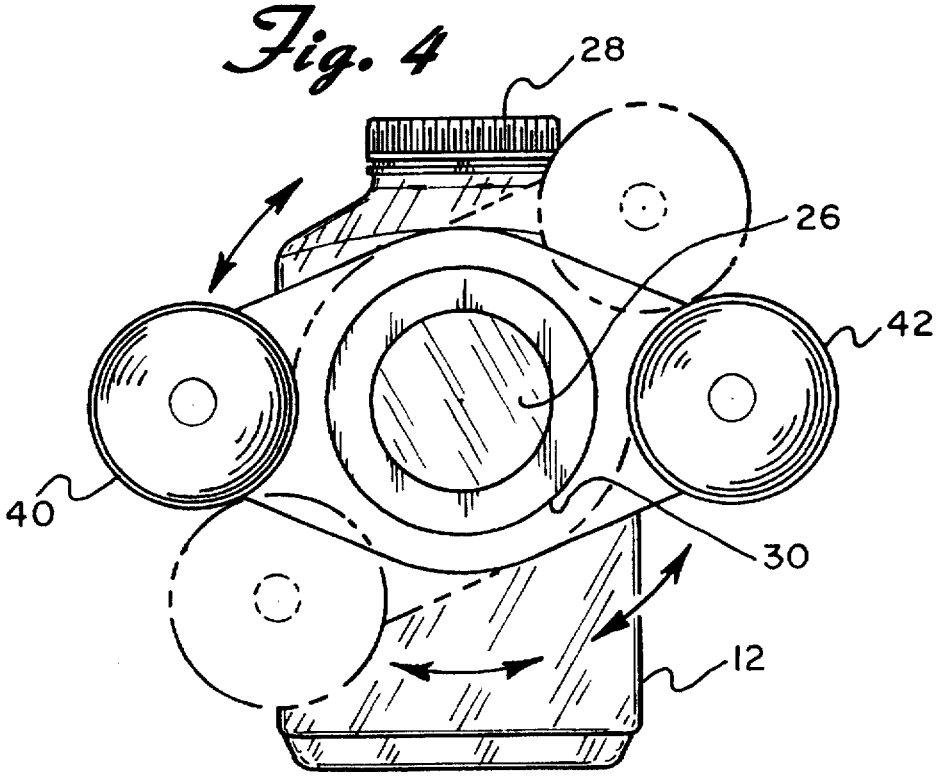
FIG. 4 is a rear elevational view of the gasoline spill eliminator with the mounting bracket shown to be rotatable.
Figure 3:
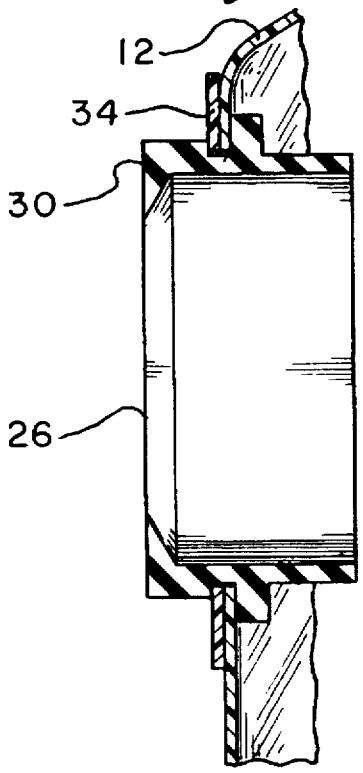
FIG. 3 is a partial cross-sectional view of the gasoline spill eliminator taken along lines 3—3 of FIG. 1.

The container 12 is attached to the boat by means of a bracket 34. The bracket 34 is flexible and has two support wings 36 and 38. Suction cups 40 and 42 are attached to the wings 36 and 38, respectively, by means of tabs 41 and 43 formed respectively on the suction cups 40 and 42 which fit through a hole in each wing. (See FIG. 1.) The part 32 of the gasket 30 which extends outwardly holds the bracket 34 in place on the container 12. That is, the bracket has a central hole through which the part 32 securely fits and retains the bracket 34 against rear wall 16. It should be understood, however, that the bracket is not so tightly held that it is immovable. The bracket 34 is made from a rigid but flexible resilient material so that it may be manipulated. It may also be rotated so that the location of the suction cups 42 and 44 may be varied, as seen in phantom in FIG. 4. In this manner, the bracket 34 may be turned and flexed in order to better position the suction cups 40 and 42 around a vent hole whose location may be obstructed or not easily reached.

In order to facilitate an understanding of the principles associated with the foregoing apparatus, its operation will now be briefly described. When it is time to fill the fuel tank of a boat, the cap of the opening 26 is removed and the gasoline spill eliminator 10 is mounted to the hull of a boat by means of the suction cups 40 and 42 on the bracket 34. The bracket 34 may be flexed or rotated in order to properly secure the suction cups 40 and 42 to a surface near the vent hole. In this manner, the bracket 34 may be adjusted to accommodate a vent hole which may be somewhat obstructed or difficult to reach. The inlet opening 26 and hole 31 of the gasket 30 are aligned with the vent hole so that the fuel may flow into the interior of the container 12.

As the boat's fuel tank is being filled, the liquid fuel rises therein until it starts to fill the overflow line. Eventually, the fuel starts to come out of the overflow vent stack or tube. This excess fuel from the overflow vent stack flows through the inlet opening 26 in the container 12 and into the interior of the container 12. Since at least a portion of the container 12 is translucent, the operator can observe the fuel flowing into and beginning to fill the container 12. This serves to indicate to the operator that further refueling is not necessary.

Since the gasoline spill eliminator is firmly secured to the boat, it can remain in place for extended periods of time. This is particularly advantageous since the fuel within the tank typically expands as the temperature rises throughout the day thereby causing fuel from a filled tank to exit through the vent stack.

When the operator desires to empty the container 12, he or she simply pulls the device 10 outwardly away from the boat. Thereafter, the cap 28 can be removed and any fuel in the container 12 can be emptied through the opening at the top of the container. The gasoline spill eliminator 10 can then be reattached to the boat in the manner described above.

The present invention may be embodied in other specific forms without departing from the spirit or essential attributes thereof and accordingly reference should be made to the appended claims rather than to the foregoing specification as indicating the scope of the invention.

I claim:

1. A gasoline spill eliminator for attachment to a boat and over an overflow vent stack extending therefrom comprising:

a container with an inlet opening and a means for mounting said container to the boat wherein said mounting means includes a bracket which is flexible and rotatable and a pair of suction cups so that said bracket may be manipulated to fit over the overflow vent stack of the boat.

2. The gasoline spill eliminator of claim 1 wherein said container is comprised of a translucent material.

3. The gasoline spill eliminator of claim 1 wherein said container has a substantially rectangular configuration.

4. The gasoline spill eliminator of claim 1 wherein said bracket includes two wings and each of said suction cups is attached to a wing.

5. The gasoline spill eliminator of claim 1 further including a gasket in said inlet opening.

* * * * *